US011527123B2

(12) United States Patent
Umeda

(10) Patent No.: US 11,527,123 B2
(45) Date of Patent: Dec. 13, 2022

(54) COIN DELIVERY DEVICE AND COIN PROCESSING DEVICE

(71) Applicant: ASAHI SEIKO CO., LTD., Tokyo (JP)

(72) Inventor: Masayoshi Umeda, Saitama (JP)

(73) Assignee: ASAHI SEIKO CO., LTD., Tokyo (JP)

( * ) Notice: Subject to any disclaimer, the term of this patent is extended or adjusted under 35 U.S.C. 154(b) by 273 days.

(21) Appl. No.: 16/937,696

(22) Filed: Jul. 24, 2020

(65) Prior Publication Data

US 2021/0104111 A1 Apr. 8, 2021

(30) Foreign Application Priority Data

Oct. 7, 2019 (JP) ..... JP2019-184327
May 25, 2020 (JP) ..... JP2020-090503

(51) Int. Cl.

| | |
|---|---|
| ***G07D 3/12*** | (2006.01) |
| ***G07D 5/02*** | (2006.01) |
| ***G07D 9/00*** | (2006.01) |
| ***G07D 3/02*** | (2006.01) |

(52) U.S. Cl.

CPC ..... *G07D 3/128* (2013.01); *G07D 3/02* (2013.01); *G07D 5/02* (2013.01); *G07D 9/008* (2013.01)

(58) Field of Classification Search

CPC ..... G07D 3/128; G07D 5/02; G07D 9/008; G07D 3/02

See application file for complete search history.

(56) References Cited

U.S. PATENT DOCUMENTS

| | | | | |
|---|---|---|---|---|
| 7,682,230 | B2 | 3/2010 | Enomoto | |
| 9,064,361 | B2 | 6/2015 | Umeda | |
| 9,105,140 | B2 | 8/2015 | Enomoto | |
| 9,934,638 | B2 | 4/2018 | Blythin et al. | |
| 2007/0087675 | A1* | 4/2007 | Umeda | G07D 9/008 453/3 |

(Continued)

FOREIGN PATENT DOCUMENTS

| | | | |
|---|---|---|---|
| EP | 2410495 | A1 | 1/2012 |
| JP | 2011-165003 | A | 8/2011 |
| JP | 2012-190334 | A | 10/2012 |

OTHER PUBLICATIONS

Extended European Search Report issued in European Patent Office (EPO) Patent Application No. 20198573.6, dated Feb. 25, 2021.

*Primary Examiner* — Jeffrey A Shapiro

(74) *Attorney, Agent, or Firm* — Greenblum & Bernstein, P.L.C.

(57) ABSTRACT

Provided is a coin delivery device including a disc including a concave portion that holds a plurality of coins in a storage container one by one. A first concave portion that holds at least coins having a diameter equal to or larger than a first diameter, and a second concave portion that holds coins having a diameter less than a second diameter are provided in the disc. The first concave portion does not perform holding of coins having a small diameter or delivery of the coins to the next step, and the second concave portion performs holding of coins having a small diameter or delivery of the coins to the next step. Since the first concave portion does not hold two coins, and two coins are not put into the second concave portion, coins can be appropriately sent out one by one to the next step.

6 Claims, 10 Drawing Sheets

(56) References Cited

U.S. PATENT DOCUMENTS

| | | | | |
|---|---|---|---|---|
| 2009/0029638 | A1* | 1/2009 | Enomoto | G07D 9/008 453/57 |
| 2012/0238196 | A1 | 9/2012 | Umeda | |
| 2014/0057542 | A1* | 2/2014 | Abe | G07D 9/008 453/3 |
| 2016/0171809 | A1* | 6/2016 | Ohtomo | G07D 5/08 194/317 |
| 2016/0240027 | A1* | 8/2016 | Onishi | G07D 9/008 |
| 2016/0364933 | A1 | 12/2016 | Enomoto | |
| 2019/0073851 | A1 | 3/2019 | Umeda | |
| 2020/0265666 | A1 | 8/2020 | Yamamiya | |
| 2020/0286319 | A1 | 9/2020 | Yamamiya | |
| 2020/0286320 | A1 | 9/2020 | Enomoto | |

* cited by examiner

[Fig. 1]
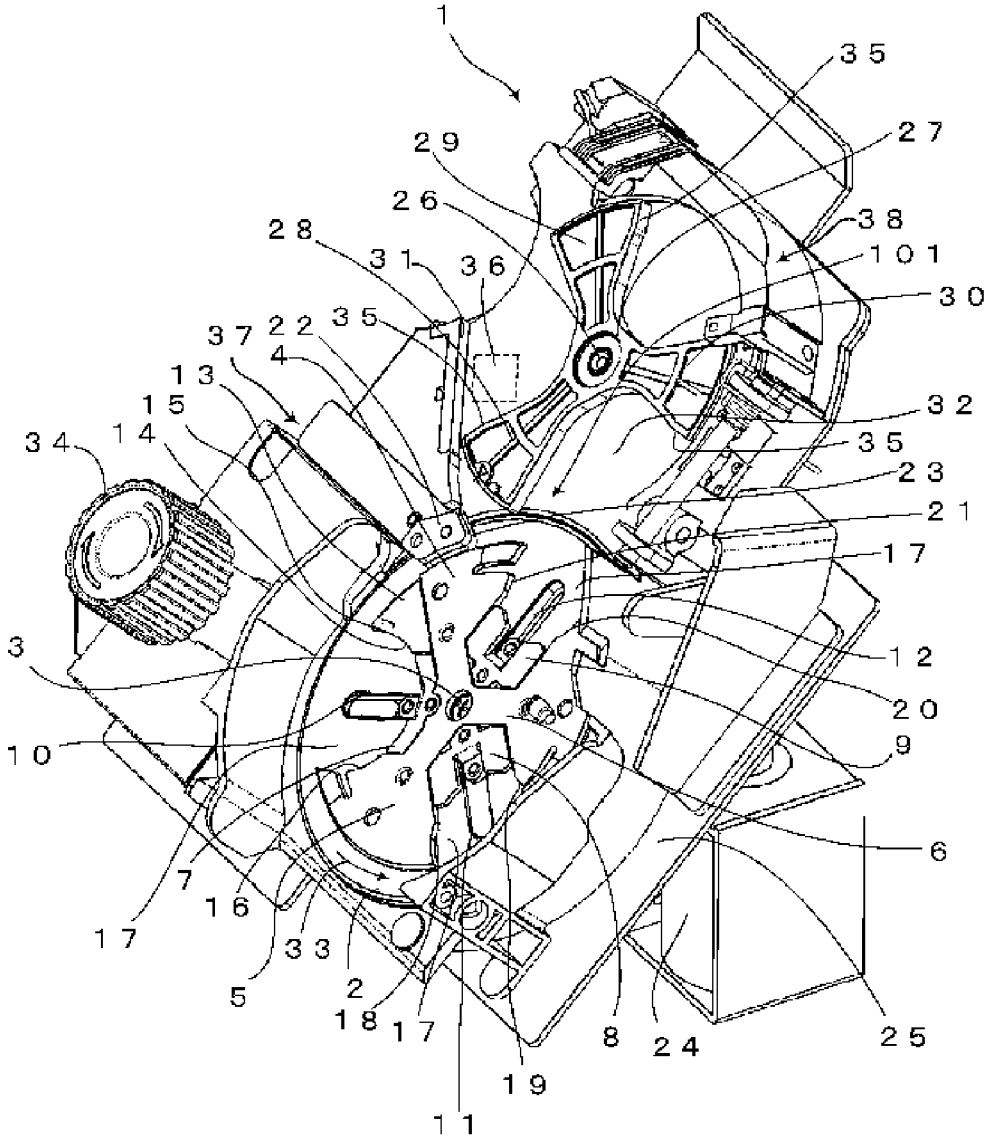

[Fig. 2]
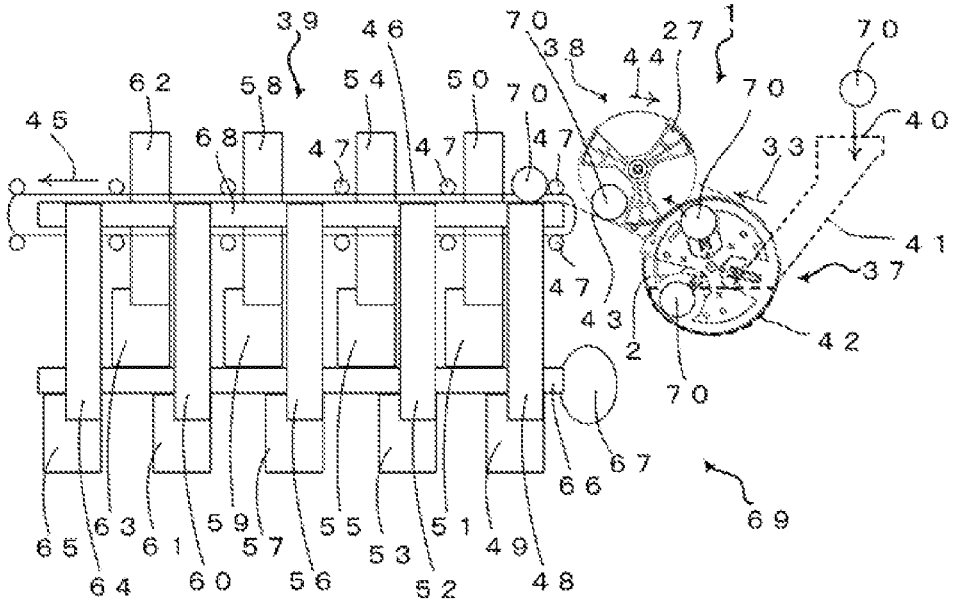
[Fig. 3]
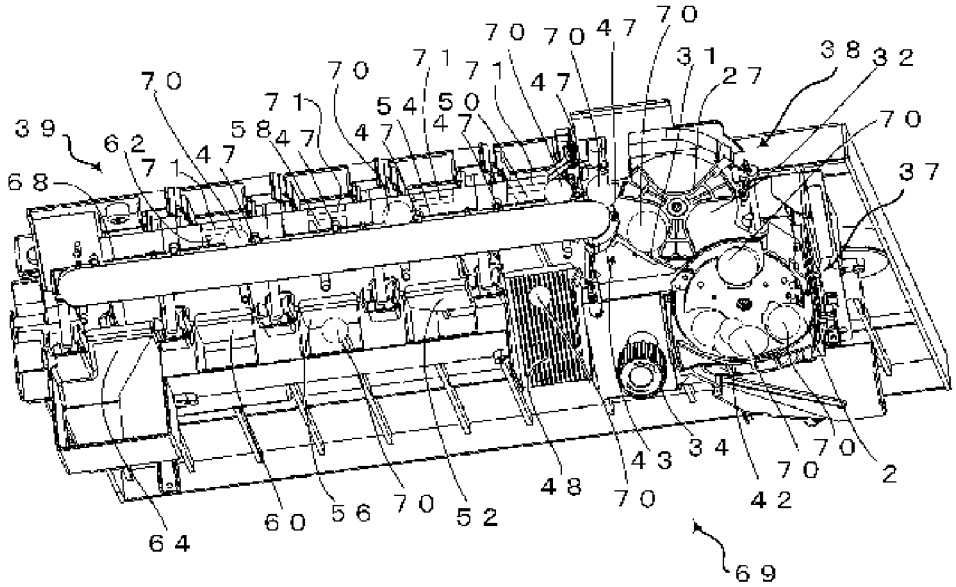

[Fig. 4]
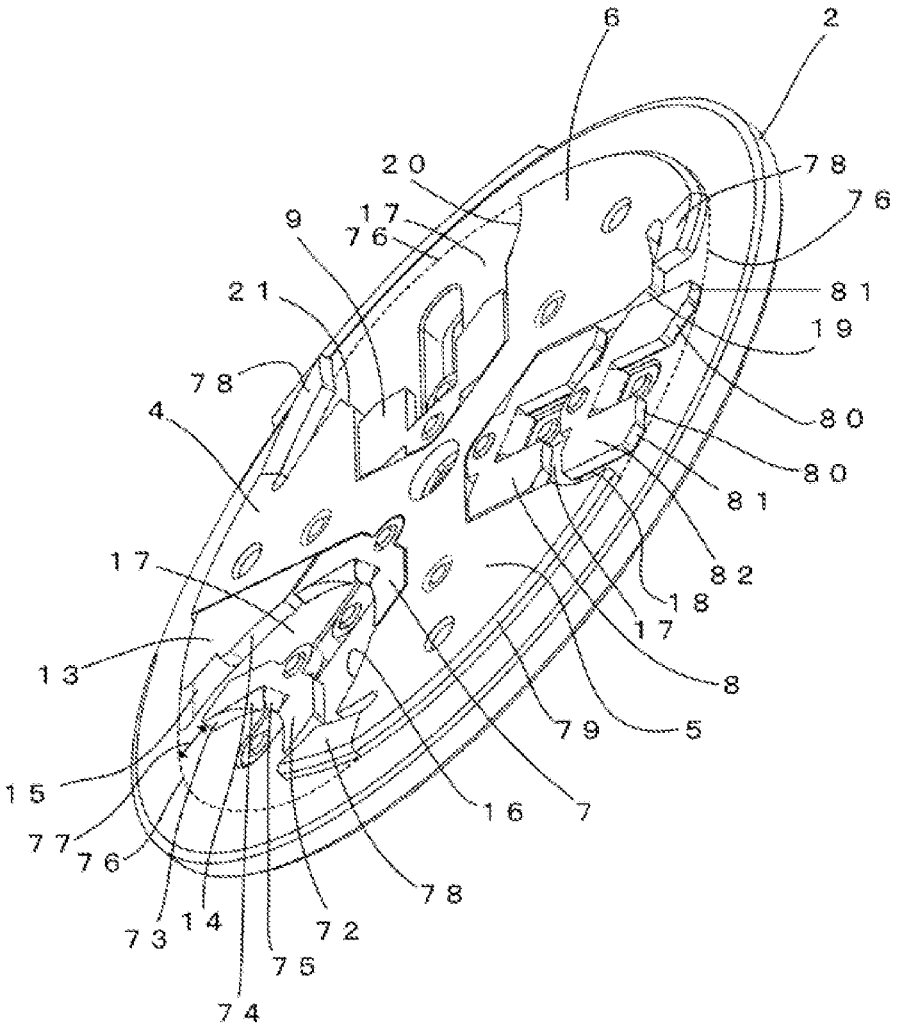

[Fig. 5]
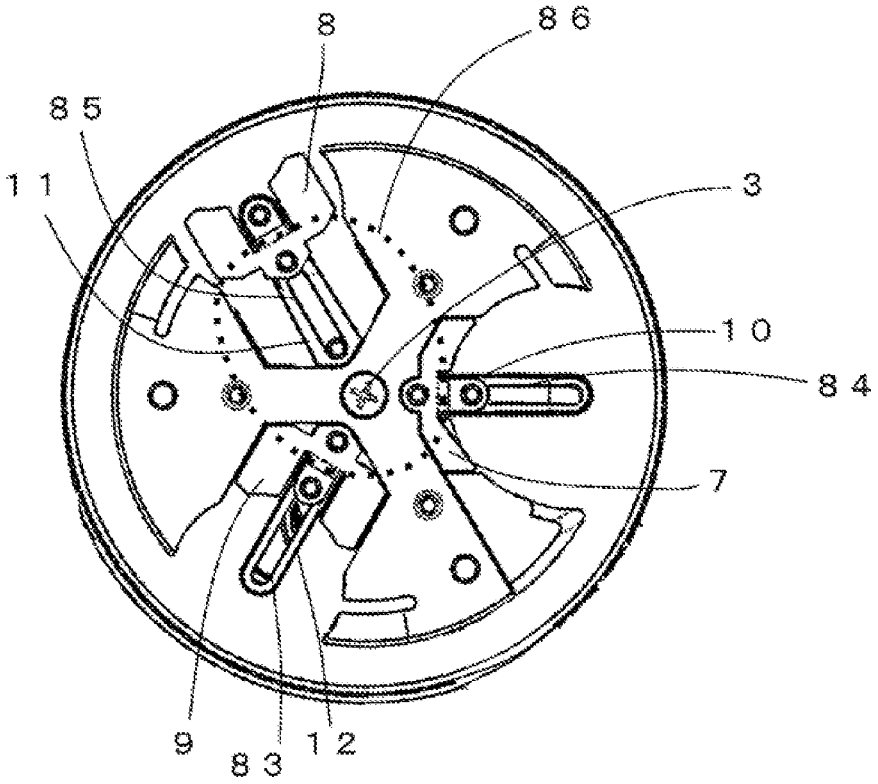

[Fig. 6]
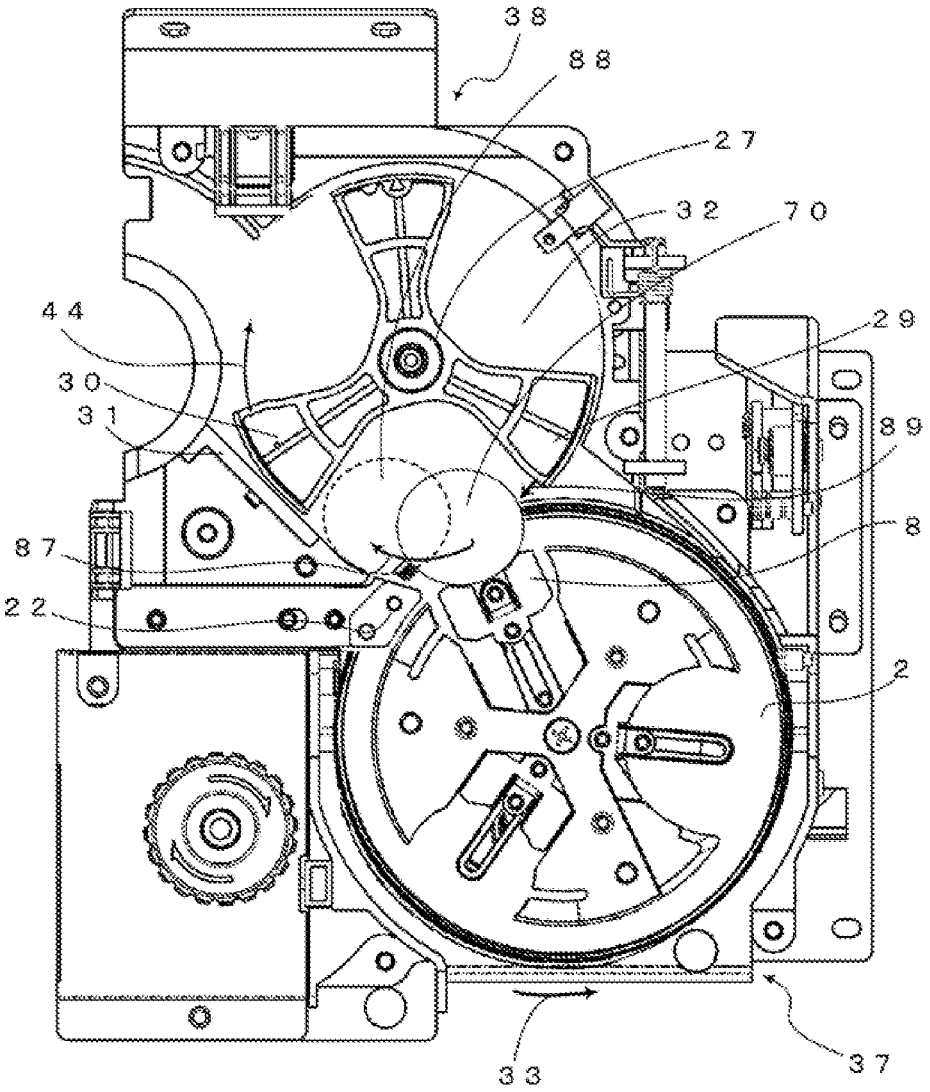

[Fig. 7]
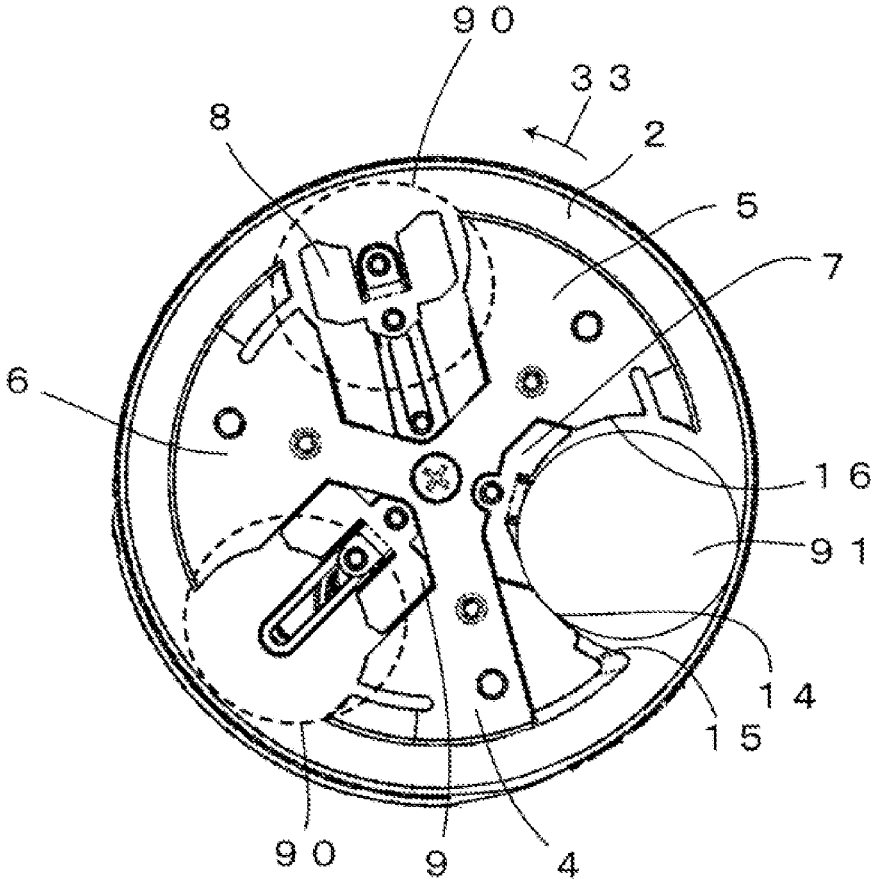

[Fig. 8]
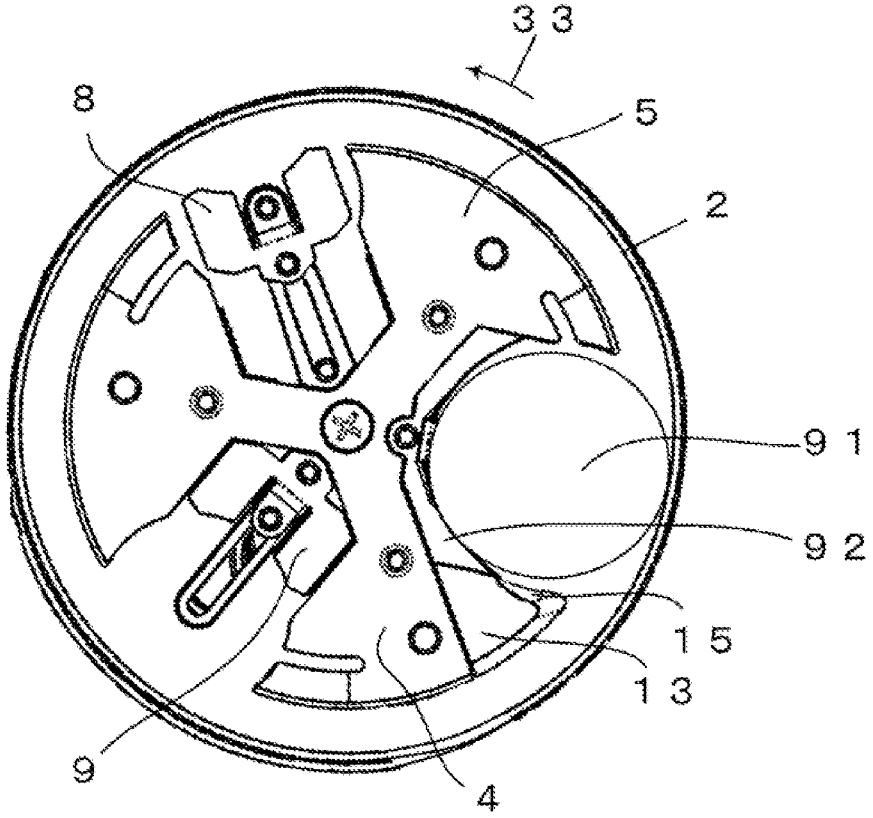

[Fig. 9]
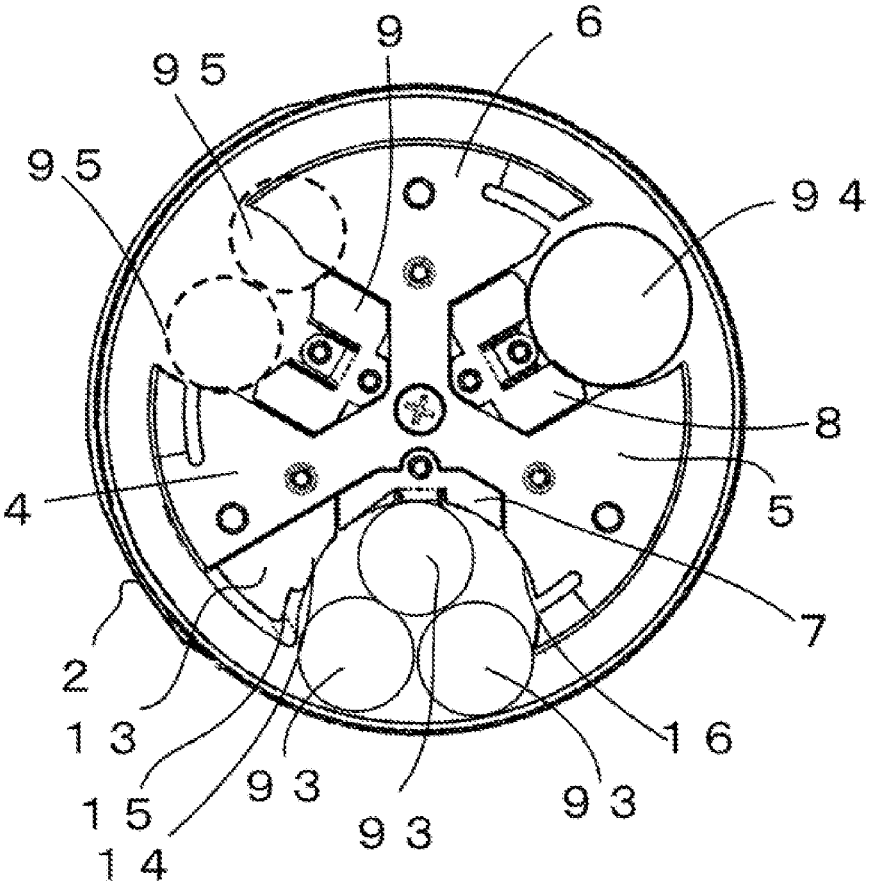

[Fig. 10]
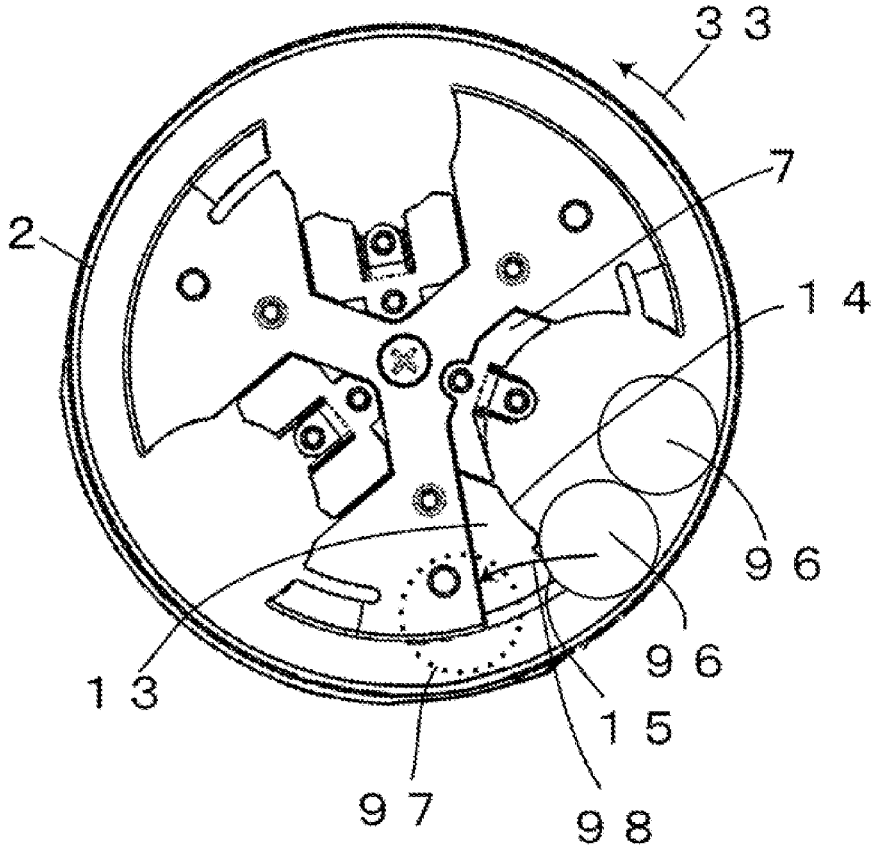

[Fig. 11]
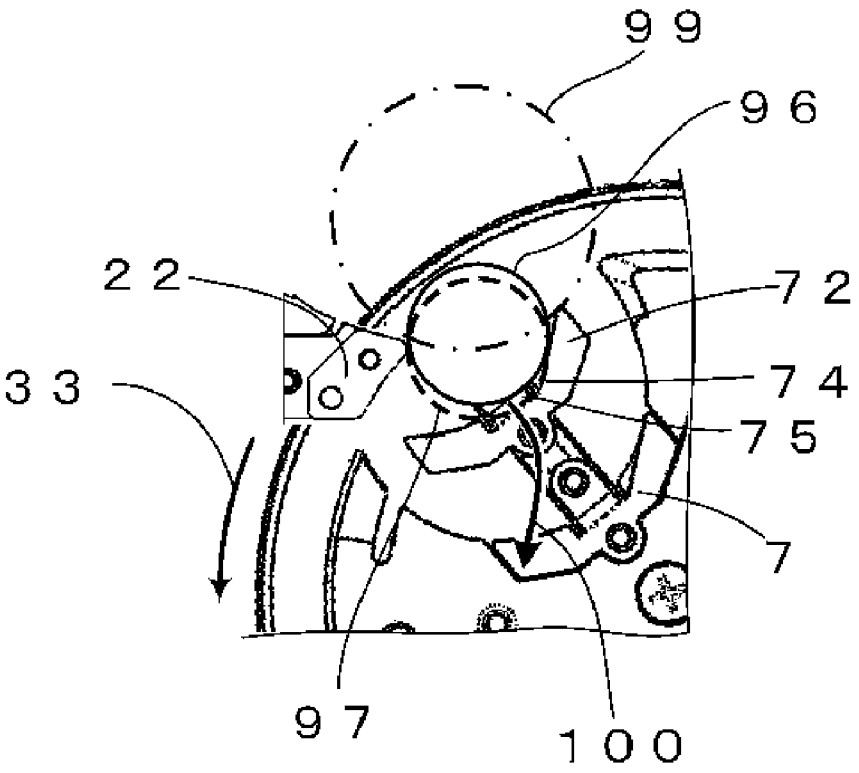

COIN DELIVERY DEVICE AND COIN PROCESSING DEVICE

BACKGROUND OF THE INVENTION

Field of the Invention

The present invention relates to a coin delivery device that sends out coins one by one, and a coin processing device that includes the coin delivery device.

Description of Related Art

In general, currency issued by a country includes coins of a plurality of denominations. Since coins have different diameters, thicknesses, materials, and designs for each denomination, anyone can easily identify the denominations. Since each denomination has different characteristics, it is also possible to identify the denomination by a machine. However, it is conceivable that erroneous identification is performed under exceptional conditions such as two coins overlapping each other. For this reason, it is necessary to separate coins one by one and convey them to an identification device to identify the denominations of the coins.

For example, a coin delivery device disclosed in Japanese Patent Laid-Open No. 2011-165003 is known as a device that sends out coins in a storage container one by one.

Such a coin delivery device includes steps in two stages. The steps include first a step of sending out a plurality of coins one by one, and then a step of identifying the denominations of coins conveyed one by one. In addition, a coin processing device is provided to have a step of separating out and storing identified coins according to denominations at a stage after the coin delivery device.

The coin delivery device includes a disc which is obliquely disposed. A storage container accommodating coins is disposed below the disc. The disc is rotated to pick up a plurality of coins in a storage container one by one. The disc is provided with a concave portion into which one coin is put. The concave portion of the rotating disc passes through the inside storage container, and thus only one coin accumulated in the storage container is put into the concave portion and conveyed. A mechanism for delivering a coin to the next step is provided above the disc. The coin is conveyed above the disc and delivered to the next step. In the next step, the denomination of the coin is identified. The denomination of the coin is identified using a plurality of sensors that detect characteristics such as the sizes and materials of coins. In this manner, the coin delivery device takes out one coin from a plurality of coins, sends out the coins one by one to the next step, and identifies the denominations of the coins.

Further, in the coin processing device, coins can be further delivered to the next step after identification. In the next step, coins are conveyed by a belt. In this step, a slide is disposed for each denomination in the middle of a conveyance path of the belt, and each of the slides is connected to a coin hopper disposed for each denomination. A coin of which the denomination has been identified is dropped onto the slide of the corresponding denomination during conveyance. The coin dropped onto the slide slides down to the storage container of the coin hopper for each denomination and is stored therein.

The coin hopper can discharge a desired number of coins. Examples of the coin processing device include an automatic change machine and the like. The automatic change machine arithmetically calculates the denominations and the number of coins to be discharged according to the amount of change, and controls coin hoppers corresponding to the denominations to discharge necessary coins.

SUMMARY OF THE INVENTION

There are various sizes of coins used in different countries. In many countries, a maximum diameter of a coin in distribution is less than twice a minimum diameter thereof. In this case, a disc may be provided with a concave portion having a diameter slightly larger than the maximum diameter. Since two coins having a minimum diameter cannot be put into the concave portion, two coins are not sent to the next step at the same time.

However, a maximum diameter of a coin in distribution may also be larger than twice a minimum diameter thereof. In this case, two or more coins each having a minimum diameter may be put into a concave portion corresponding to the maximum diameter of the coin. In a case where two coins are conveyed to the next step at the same time, there is a concern that the denominations of the coins may be erroneously identified.

The present invention provides a coin delivery device capable of appropriately sorting and conveying coins one by one without being affected by the diameters of the coins, and a coin processing device including the coin delivery device.

A coin delivery device according to an aspect of the present invention includes a disc that has a holding unit on an upper surface thereof, the holding unit holding a coin, a storage container that stores a plurality of coins, and a supporting piece that presses side surfaces of the coins held by the holding unit to move the coins in a direction circumferentially outward from the disc, in which the coin delivery device is configured to hold the coins in the storage container by the holding unit and rotate the disc to send out the coins moving in the direction circumferentially outward from the disc by the supporting piece one by one to a next step from a delivery port disposed on an upper side of the disc, and is configured such that the disc is disposed obliquely in a horizontal direction, and the storage container is disposed on a lower side of the disc, and the holding unit includes a first holding unit and a second holding unit, the first holding unit sending out only coins having a diameter equal to or larger than a first diameter to the next step from the delivery port and not sending out coins having a diameter less than the first diameter to the next step from the delivery port in a case where the number of coins held is one, and not sending out two coins held to the next step from the delivery port in a case where the number of coins held at the same time is two, and the second holding unit not holding coins having a diameter exceeding a second diameter smaller than a maximum diameter among the coins held by the first holding unit, and sending out a coin to the next step from the delivery port and not holding two coins having a diameter equal to or less than the second diameter at the same time in a case where the second holding unit holds one coin having a diameter equal to or less than the second diameter.

The coin processing device according to the first aspect of the present invention includes the above-described coin delivery device, an identification unit that receives the coins from the coin delivery device and identifies denominations of the coins, and an accommodation unit that includes coin hoppers corresponding to the denominations of the coins and accommodates the coins in the coin hoppers, in which the coins are stored in the coin hoppers corresponding to the denominations identified by the identification unit.

In the present invention, a first holding unit holding a coin having a maximum diameter, out of the first holding unit and a second holding unit in holding units of a disc, sends out only coins each having a diameter equal to or larger than a first diameter to the next step through a delivery port. It is assumed that the first holding unit holds two or more coins each having a smaller diameter than the first diameter. In this case, the first holding unit can return a held coin having a smaller diameter to a storage container without sending out the coin to the next step from the delivery port. A function of sending out only coins each having a diameter equal to or larger than the first diameter to the next step from the first holding unit can be realized by, for example, the following configurations. That is, the configurations include a configuration in which sending out of a coin having a smaller diameter to the next step from the first holding unit is inhibited, a configuration in which a coin having a smaller diameter is slid down from the first holding unit until the first holding unit is moved to a position facing the delivery port in association with the rotation of the disc, and the like. With such a configuration, it is possible to prevent one coin or two or more coins held by the first holding unit from being delivered to the next step. It is possible to sort coins one by one and appropriately send out the coins to the next step. Further, it is possible to sort and send out coins one by one from the storage container, and thus the denominations of the coins can be appropriately identified.

BRIEF DESCRIPTION OF THE DRAWINGS

FIG. 1 is a perspective view of a coin delivery device.

FIG. 2 is a diagram showing an outline of a coin processing device.

FIG. 3 is a perspective view of main portions of the coin processing device.

FIG. 4 is a perspective view of a disc portion of the coin delivery device.

FIG. 5 is a diagram showing operations of the disc portion.

FIG. 6 is a diagram showing the delivery of a coin.

FIG. 7 is a diagram showing a first example in a case where a large diameter coin is held.

FIG. 8 is a diagram showing a second example in a case where a large diameter coin is held.

FIG. 9 is a diagram showing a state where two or more small diameter coins are held.

FIG. 10 is a diagram showing a first example of an operation in a case where a small diameter coin is held.

FIG. 11 is a diagram showing a second example of an operation in a case where a small diameter coin is held.

DETAILED DESCRIPTION OF THE INVENTION

Hereinafter, an embodiment of the present invention will be described in detail with reference to the accompanying drawings. The drawings are merely shown schematically such that the present invention can be sufficiently understood. Accordingly, the present invention is not limited to examples shown in the drawings. Further, in the drawings, common components and similar components will be denoted by the same reference numerals and signs, and repeated description thereof will be omitted.

First, a coin processing device will be described using FIG. 2. FIG. 2 is a diagram showing an outline of the coin processing device. There are a plurality of denominations of commonly used coins. Elements such as a size, a material, and a design are different for each denomination of coins. The coin processing device can identify coins, sort the coins according to denominations, and accommodate the coins. In addition, the accommodated coins are reused for dispensation and the like.

Examples of a coin processing device 69 include an automatic change machine, an automatic money changer, and the like. The coin processing device 69, which is inserted in a state where coins of a plurality of denominations are mixed, separates out the coins one by one, identifies the denominations of the separated out coins, and stores the identified coins according to denominations. Further, the coin processing device 69 can dispense coins corresponding to a desired amount of money from the stored coins.

The coin processing device 69 is roughly divided into three portions. That is, the portions include a sending portion 37 that sorts inserted coins one by one and sends out the coins, an identification unit 38 that identifies the denomination of the coins, and an accommodation unit 39 that separates out the coins according to the denominations and stores the separated out coins. The coin delivery device 1 may be configured to include the sending portion 37 and include other functions such as the identification unit 38. Here, description will be given on the assumption that the coin delivery device 1 is a device configured to include the sending portion 37 and the identification unit 38.

A coin 70 put into a coin slot 40 passes through a coin passage 41 and is stored in a storage container 42. The coin slot 40, the coin passage 41, and the storage container 42 are indicated by dashed lines in FIG. 2. In addition, a plurality of coins 70 can be put in the storage container 42 without being separated out according to denominations.

The storage container 42 is disposed on a lower side of a disc 2. A bottom having a shape along the outer circumference of the disc 2 is formed in the storage container 42. The storage container 42 covers approximately one third from the lower half of the disc 2. In addition, the disc 2 is obliquely disposed such that a coin leans against the disc 2 side. A plurality of coins lean against the disc 2 side and, the disc 2 rotates, so that the coins are inserted into a concave portion to be described later and are conveyed.

The disc 2 can hold the coin 70. The disc 2 is provided with a concave portion recessed in the thickness direction of the disc, and the coin 70 is held in the concave portion. The bottom surface of the concave portion is flat. An inner wall of the concave portion is formed by side walls of convex portions (a first arm 4, a second arm 5, a third arm 6, a sorting portion 13 to be described later) protruding from the flat bottom surface of the concave portion and is disconnected in a region on the outer circumferential side of the disc 2. The side surface of the coin 70 inserted into the concave portion abuts on the inner wall of the concave portion (the side walls of the convex portions). The disc 2 is disposed to take an oblique posture with respect to the horizontal direction. The disc 2 is inclined such that the coin 70 can be appropriately inserted into the concave portion of the disc 2. An example of an inclination angle may be approximately 30 degrees to 80 degrees. An inclination angle of 40 degrees to 50 degrees is more preferable. An unnecessary coin 70 does not slide off from the concave portion when an inclination angle is small, and it becomes difficult to insert a coin into the concave portion when an inclination angle is large.

The coin 70 is held in the concave portion with the front surface or the back surface of the coin 70 facing the flat bottom surface of the concave portion. In addition, the inner wall of the concave portion is disconnected in a region on the outer circumferential side of the disc 2, and the coin 70 passes through the disconnected region and is conveyed to the next step. A guidance surface for guiding a coin in a disc rotation direction is disposed outside the outer circumference of the disc 2. The coin 70 is conveyed in a state where the side surface of the coin 70 is brought into contact with the inner wall of the concave portion and the guidance surface.

The disc 2 rotates in a disc rotation direction 33 indicated by an arrow, and thus the coins 70 stored in the storage container 42 can be picked up one by one by the concave portion. Since the disc 2 is obliquely disposed with respect to the horizontal direction, the coin 70 in the storage container 42 is inserted into the concave portion which is an area of the disc 2 for holding the coins 70. The coin 70 is held by the bottom surface of the disc 2, a wall portion, and the guidance surface and conveyed.

The coin 70 is delivered to a position which is a portion above the sending portion 37 and a portion below the identification unit 38. The coin 70 conveyed upward by the disc 2 is sent out to the identification unit 38 from the disc 2. The disc 2 can take out the plurality of coins 70 stored in the storage container 42 one by one and deliver the taken-out coins to the next step.

In the identification unit 38, a reception wheel 27 disposed on a flat reception base (32 in FIG. 1 to be described later) which is a base of the coin delivery device 1 rotates in a reception wheel rotation direction 44 indicated by an arrow. The reception wheel 27 rotates in association with the rotation of the disc 2. The coin 70 sent out from the identification unit 38 moves on the reception base with its side surface abutting the reception wheel 27 and being pressed thereagainst. The identification unit 38 identifies the denomination of the coin 70 by causing a sensor to detect features such as the size and material of the coin 70 moving on the above-described reception base and by using a control unit not shown in the drawing. Since the coins 70 are conveyed by being sorted one by one, the identification unit 38 can appropriately identify the denominations of the coins 70. The coin 70 is moved along a guiding path 43 in a state where the front surface or back surface thereof is brought into contact with the above-described reception base and the side surface thereof is brought into contact with the guiding path 43, and is delivered to the accommodation unit 39 which is the next step.

In the accommodation unit 39, a conveyance path 68 continuous with the guiding path 43 is disposed. The coin 70 is conveyed along the conveyance path 68. A belt 46 is disposed along the conveyance path 68. Conveyance pins 47 are disposed at equal intervals in the belt 46. One coin 70 is inserted between the conveyance pins 47 and is conveyed while being pressed by the conveyance pins 47. The belt 46 is an endless belt and rotates in a belt rotation direction 45 indicated by an arrow in association with the disc 2 and the reception wheel 27. The accommodation unit 39 can hold the coins 70 one by one in a region divided by the conveyance pins 47 in the belt 46 and convey the coins.

A first slide 48, a second slide 50, a third slide 52, a fourth slide 54, a fifth slide 56, a sixth slide 58, a seventh slide 60, an eighth slide 62, and a ninth slide 64 are disposed along the conveyance path 68. These slides are connected to a coin hopper of a denomination determined in advance. The coin 70 identified by the identification unit 38 is dropped onto a slide of a corresponding denomination and is stored in a coin hopper of the corresponding denomination.

The coin 70 identified by the identification unit 38 is dropped onto any slide. That is, the first slide 48 is connected to a first coin hopper 49, the second slide 50 is connected to a second coin hopper 51, the third slide 52 is connected to a third coin hopper 53, the fourth slide 54 is connected to a fourth coin hopper 55, the fifth slide 56 is connected to a fifth coin hopper 57, the sixth slide 58 is connected to a sixth coin hopper 59, the seventh slide 60 is connected to a seventh coin hopper 61, the eighth slide 62 is connected to an eighth coin hopper 63, and the ninth slide 64 is connected to a collecting container 65.

The collecting container 65 is used, for example, to collect old coins of which distribution is desired to be curbed such that the old coins are not reused.

The coin hoppers are disposed along a dispensing belt 66. The accommodation unit 39 can convey coins discharged from the coin hoppers to a dispensing tray 67 by driving the dispensing belt 66. The accommodation unit 39 of the coin processing device 69 according to the embodiment can deal with eight different denominations.

The coins 70 inserted from the coin slot 40 are separately conveyed one by one. The denominations of the coins 70 are identified, and the coins 70 are stored in coin hoppers corresponding to identification results. In addition, the coin hopper discharges a required number of coins to dispense the coins to the dispensing tray 67. In this manner, the inserted coins 70 can be reused for dispensation.

Next, the coin delivery device 1 will be described. FIG. 1 is a perspective view of the coin delivery device. This drawing is a perspective view in a state where the storage container 42 is removed from the sending portion 37.

The sending portion 37 and the identification unit 38 are disposed in the frame 25. The disc 2 rotates around the disc rotary shaft 3. The reception wheel 27 rotates around the wheel rotary shaft 26. The disc rotary shaft 3 and the wheel rotary shaft 26 are rotated by a motor 24. The motor 24 and the disc rotary shaft 3 are connected to each other by a train wheel not shown in the drawing. In addition, the motor 24 and the wheel rotary shaft 26 are connected to each other by a train wheel not shown in the drawing. The motor 24 and the train wheel not shown in the drawing constitute a driving unit that rotates the disc 2 and the reception wheel 27.

A holding base 17 of the disc 2 forms a flat bottom surface on which coins are disposed and held. A reception base 32 of the identification unit 38 forms a flat bottom surface for holding coins. The reception wheel 27 is rotatably disposed while facing the reception base 32. The holding base 17 and the reception base 32 are disposed without a step therebetween, so that coins can be slid and moved.

A holding unit which is an area for holding coins is provided on an upper surface of the disc 2. The holding bases 17 are provided at a plurality of locations at equal angles around the disc rotary shaft 3 on the upper surface of the disc 2. For example, the holding bases are provided at three locations at intervals of 120 degrees.

The first arm 4, the second arm 5, and the third arm 6 extend radially around the disc rotary shaft 3. The arms are provided to protrude with respect to the holding bases 17. As the holding unit for holding coins, a concave portion is formed by the arms disposed around the holding base 17 which is a bottom surface. That is, the disc 2 is provided with three holding units for holding coins. A portion of each of the first arm 4, the second arm 5, and the third arm 6 can also be referred to as a convex portion constituting the holding unit. It can also be said that an upstream side convex portion is provided on an upstream side of the holding unit in a rotation direction, and a downstream side convex portion is provided on a downstream side. That is, a first holding unit includes a first upstream side convex portion and a first downstream side convex portion, a second holding unit includes a second upstream side convex portion and a second downstream side convex portion, and a third holding unit includes a third upstream side convex portion and a third downstream side convex portion.

In the arms, portions on the disc rotary shaft 3 sides in the respective extending directions are connected to each other and integrated. Tip ends of the respective arms are disposed along the same circumference around the disc rotary shaft 3. The arms are provided to protrude from the holding bases 17. In addition, the holding base 17 is disposed at a position interposed between the arms. A coin is disposed on the holding base 17 and conveyed.

A first elongate hole 10 and a first supporting piece 7, a second elongate hole 11 and a second supporting piece 8, and a third elongate hole 12 and a third supporting piece 9 are respectively disposed in three holding bases 17. The first supporting piece 7 moves in a longitudinal direction of the first elongate hole 10. The second supporting piece 8 moves in a longitudinal direction of the second elongate hole 11. The third supporting piece 9 moves in a longitudinal direction of the third elongate hole 12. The first supporting piece 7, the second supporting piece 8, and the third supporting piece 9 are moved in association with the rotation of the disc 2 by a grooved cam to be described later.

The holding base 17 having the second supporting piece 8 disposed thereon and the surrounding area of the holding base 17 constitute the second holding unit. The holding base 17 mentioned above is interposed between a fourth side wall 18 of the second arm 5 and a fifth side wall 19 of the third arm 6. When the disc 2 is rotating in the disc rotation direction 33, a side surface of a coin comes into contact with the fourth side wall 18 or the fifth side wall 19. The fourth side wall 18 and the fifth side wall 19 also serve as a convex portion constituting a portion of the second holding unit. The holding base 17 having the second supporting piece 8 disposed thereon can also be referred to as a second holding base constituting a bottom surface of the concave portion.

The holding base 17 having the third supporting piece 9 disposed thereon and the surrounding area of the holding base 17 constitute a third holding unit. The holding base 17 mentioned above is interposed between a sixth side wall 20 of the third arm 6 and a seventh side wall 21 of the first arm 4. When the disc 2 is rotating in the disc rotation direction 33, a side surface of a coin comes into contact with the sixth side wall 20 or the seventh side wall 21. The sixth side wall 20 and the seventh side wall 21 also serve as a convex portion constituting a portion of the third holding unit. The holding base 17 having the third supporting piece 9 disposed thereon can also be referred to as a third holding base constituting a bottom surface of the concave portion.

It is preferable that the fourth side wall 18 or the fifth side wall 19 be disposed perpendicular to the flat holding base 17 in order to make it possible to hold coins by the holding base 17 disposed obliquely and the fourth side wall 18 or the fifth side wall 19. Alternatively, the fourth side wall 18 or the fifth side wall 19 may be slightly inclined, but it is necessary to set an angle to such a degree that a coin does not slide off. This is the same for the sixth side wall 20 and the seventh side wall 21, and a first side wall 14 and a third side wall 16 to be described later.

The holding base 17 having the first supporting piece 7 disposed thereon and the surrounding area of the holding base 17 constitute a first holding unit. The holding base 17 mentioned above is interposed between the sorting portion 13 of the first arm 4 and the third side wall 16 of the second arm 5. The sorting portion 13 provided to protrude with respect to the holding base 17 is disposed on the left side of the first arm 4 in the drawing. The sorting portion 13 includes the first side wall 14 which is perpendicularly provided to face the holding base 17. The first side wall 14 is provided on the base side of the first arm 4. In addition, the sorting portion 13 includes a second side wall 15 provided to protrude toward the holding base 17. The second side wall 15 is provided on the tip end side of the first arm 4. The second side wall 15 includes an inclined portion of which the height increases gradually in an upstream direction of the disc rotation direction 33 from the holding base 17. On the left side of the first arm 4 in the drawing, that is, the downstream side in the disc rotation direction 33, the second side wall 15 is provided on the tip end side of the first arm 4, and the sorting portion 13 including the first side wall 14 is provided on the base side. When the disc 2 is rotating in the disc rotation direction 33, the side surface of a coin comes into contact with the sorting portion 13 or the third side wall 16. The holding base 17 having the first supporting piece 7 disposed therein can also be referred to as a first holding base constituting the bottom surface of the concave portion. In addition, the first side wall 14 is also a supporting portion that abuts on the side surface of a coin to support and convey the coin.

The holding unit includes a convex portion (an arm or the sorting portion 13) on each of the upstream side and the downstream side of the holding base 17 in the disc rotation direction 33. A coin is held by the holding unit (can also be referred to as a concave portion) including the convex portion and the holding base 17.

A guide portion is disposed outside the outer circumference of the disc 2 in order to guide the conveyance of a coin, other than a portion for delivering the coin from the disc 2 to the identification unit 38. The guide portion comes into contact with the side surface of a coin to serve as a guidance surface for the conveyance of the coin. The guide portion is provided to protrude perpendicularly with respect to the holding base 17.

The disc 2 rotates in the disc rotation direction 33 indicated by an arrow. In order to deliver a coin to the identification unit 38, supporting pieces are moved in the direction toward the outer circumferential side of the disc 2. The coin is pressed out by the supporting pieces, abuts on a knife tip end portion 23 disposed at the tip end of a reception knife 22, and rides on the tip ends of the arms. In addition, the coin is pressed by the reception wheel 27 and moves on the reception base 32. The reception base 32 and the holding base 17 are configured to be flush with each other, and thus the coin can be smoothly delivered.

The identification unit 38 detects coins moving in the guidance portion 31 one by one by the identification sensor 36 to identify the denominations of the coins.

In the reception wheel 27, a plurality of reception bodies are disposed radially at equal angles with the wheel rotary shaft 26 as a center. In the coin processing device 69 according to the embodiment, a first reception body 28, a second reception body 29, and a third reception body 30 are disposed at intervals of 120 degrees. A coin is inserted between the reception bodies, and the coin slides and moves on the reception base 32. The reception body is provided with a pressing wall 35 to abut on the side surface of a coin. That is, when the reception wheel 27 rotates, the pressing wall 35 presses the coin positioned on the reception base 32 and moves the coin. The reception wheel 27 rotates in a direction opposite to the disc 2.

In addition, a manual knob 34 can rotate the disc 2 and the reception wheel 27 in association with each other. The manual knob 34 can rotate the disc 2 and the reception wheel 27 in a forward direction or a backward direction.

Next, main portions of the coin processing device 69 will be described. FIG. 3 is a perspective view of main portions of the coin processing device.

In the sending portion 37, a plurality of coins 70 stored in the storage container 42 are separated one by one in association with the rotation of the disc 2 and delivered to the identification unit 38. In the identification unit 38, the coins 70 are separated one by one by the reception wheel 27, move to the reception base 32, and delivered to the accommodation unit 39. The coins 70 are conveyed along the guiding path 43 including the guidance portion 31. In the accommodation unit 39, the coins 70 are inserted one by one between the plurality of conveyance pins 47 disposed on the belt 46. The conveyance pins 47 are moved due to the rotation of the belt 46, and the coins 70 are pressed by the conveyance pins 47 and move on the conveyance path 68. The belt 46 rotates in association with the rotation of the disc 2 and the reception wheel 27 so that only one coin 70 is inserted between the conveyance pins 47. Each slide is provided with a bar 71, and whether or not the coin 70 is dropped onto the slide depends on the state of the bar 71 controlled by a control unit not shown in the drawing. That is, when the coin 70 arrives at the position of a slide corresponding to the denomination of the coin 70, the coin 70 is dropped onto the corresponding slide by changing the state of the bar 71. The coin 70 dropped onto the slide is stored in a coin hopper of the corresponding denomination.

Next, details of the disc 2 will be described. FIG. 4 is a perspective view of a disc portion of the coin delivery device.

The first arm 4, the second arm 5, and the third arm 6 are integrally molded and fixed to the disc 2. It is preferable that the sorting portion 13 be molded integrally with the disc 2. In a case where the sorting portion 13 and the disc 2 are molded as separate bodies, a recess is provided in a flat surface of the disc 2 to fix the sorting portion 13 which is a separate body thereto. The edge of a coin is prevented from being caught in a boundary between the sorting portion 13 and the disc 2.

A bent portion 78 prevents a plurality of coins from being lined up with the reception knife (22 in FIG. 1) as a starting point and obstructing the rotation of the disc 2. For this reason, coins on the upstream side in the rotating direction are raised not to be lined up.

The first supporting piece 7 is disposed between the first arm 4 and the second arm 5. The first supporting piece 7 can reciprocate and is positioned at a rear end in a movement range in FIG. 4. A first supporting piece 72 shown separately from the first supporting piece 7 is positioned at a tip end in the movement range. Although two first supporting pieces are shown in FIG. 4, the first supporting piece 72 positioned at the tip end is merely shown to describe the movement range of the first supporting piece 7.

A cam follower, not shown in the drawing, which is fixed to the first supporting piece 7 along a grooved cam to be described later is moved, and thus the first supporting piece 7 reciprocates. The first supporting piece 7 is formed in an arc shape protruding toward the tip end side thereof as both ends thereof in a disc rotation direction approach the tip end side (a disc outer circumferential side). In addition, a pressing portion 73 abutting on and pressing a coin is disposed on the tip end side of the first supporting piece 7. In addition, a first inclined portion 74 and a second inclined portion 75 are provided in the central portion thereof. The first inclined portion 74 and the second inclined portion 75 are provided not to convey a coin having a diameter equal to or less than a predetermined diameter to the next step (identification unit 38). In a case where the first supporting piece 7 moves in an outer circumferential direction of the disc 2, and the reception knife 22 and a coin abut on each other, the coin is lifted from the disc 2 by the first inclined portion 74 or the second inclined portion 75 and slides down to the storage container 42, so that the coin is not delivered to the next step. That is, in a case where the first holding unit holds a coin having a diameter smaller than a first diameter, the held small diameter coin is slid down by a supporting piece inclined portion including the first inclined portion 74 and the second inclined portion 75 until the first holding unit is moved to a position facing the delivery port (101 in FIG. 1) in association with the rotation of the disc 2. The first supporting piece 7 moves the small diameter coin toward the outer circumferential side of the disc 2, and thus the small diameter coin can be slid down by being reliably brought into contact with the first inclined portion 74 and the second inclined portion 75.

Edges 79 which are tip ends of the respective arms are positioned on the same circumference. In FIG. 4, a dotted line 76 indicating the contour of the above-described circumference is shown in portions in which the arms are not disposed. In a case where the first supporting piece 7 is moved to a tip end position like the first supporting piece 72, a gap of a distance 77 to a contour portion indicated by a double-headed arrow is formed. It can also be said that it is determined whether or not a coin is movable to the reception base 32 on the basis of the distance 77 and the diameter of a coin to be used (a coin being in distribution in a country where the coin processing device 69 is sold). When the diameter is large, the lower side of the coin and the reception knife 22 or the reception wheel 27 abut on each other, and thus the coin is movable to the reception base 32. When the reception knife 22 or the reception wheel 27 hits the upper portion of the coin, it is difficult for the coin to move to the reception base 32.

A maximum diameter coin to be used is put into the first holding unit including the holding base 17 having the first supporting piece 7 disposed therein and the first side wall 14 and the third side wall 16 with the holding base 17 interposed therebetween. That is, coins of all denominations to be used are inserted. However, a coin having a diameter equal to or larger than a predetermined first diameter is delivered to the identification unit 38 from the first holding unit, and a coin having a diameter smaller than the first diameter is dropped into the storage container 42 from the first holding unit. Coins having a diameter equal to or larger than the first diameter are held by the first holding unit and delivered to the next step. Coins having a diameter smaller than the first diameter are returned to the storage container 42 from the first holding unit. In addition, the second holding unit can hold coins having a diameter equal to or less than a second diameter smaller than the maximum diameter coin capable of being held by the first holding unit. Coins having a diameter smaller than the first diameter are delivered to the next step by the second holding unit or a third holding unit to be described later. There are sizes of coins that can be delivered to the next step only by the first holding unit or the second holding unit. In addition, there are sizes of coins that can be delivered to the next step by both the first holding unit and the second holding unit. This is to improve the efficiency of processing coins.

The second supporting piece 8 is disposed between the second arm 5 and the third arm 6. The second supporting piece 8 is moved to the position (tip end position) of a second supporting piece 82 shown separately from the second supporting piece 8. In FIG. 4, the second supporting piece 82 positioned at the tip end is merely shown to describe the movement range of the second supporting piece 8.

A cam follower, not shown in the drawing, which is fixed to the second supporting piece 8 along a grooved cam to be described later is moved, and thus the second supporting piece 8 reciprocates between a tip end position and a rear end position which is close to the bases of the second arm 5 and the third arm 6. The tip end side of the second supporting piece 8 is formed in an arc shape protruding toward the tip end side thereof as both ends thereof in a disc rotation direction approach the tip end side. In addition, a support side surface 80 abutting on and pressing a coin and a tip end 81 formed to have a shape along the dotted line 76 indicating the contour which extends from the edge 79 are disposed on the tip end side of the second supporting piece 8. The support side surface 80 and the tip end 81 can also be referred to as pressing portions pressing a coin. In addition, since the support side surface 80 and the tip end 81 are made to abut on the side surface of a coin, it is preferable that the support side surface 80 and the tip end 81 be formed perpendicular to the holding base 17. The support side surface 80 and the tip end 81 may be formed as slightly inclined surfaces, but the support side surface 80 and the tip end 81 may be configured to come into contact with the side surface of the coin and reliably press the coin.

In a case where the second supporting piece 8 is moved to the position (tip end position) of the second supporting piece 82, the tip end 81 is positioned at the position of the dotted line 76 indicating the contour that extends from the edge 79.

At least a maximum diameter coin to be used cannot be inserted into the second holding unit (concave portion) including the holding base 17 having the second supporting piece 8 disposed therein and the fourth side wall 18 and the fifth side wall 19 with the holding base 17 interposed therebetween.

The third supporting piece 9 is disposed between the third arm 6 and the first arm 4. The shape and movement range of the third supporting piece 9 are the same as those of the second supporting piece 8. In addition, at least a maximum diameter coin to be used cannot be inserted into the third holding unit including the holding base 17 having the third supporting piece 9 disposed therein and the sixth side wall 20 and the seventh side wall 21 with the holding base 17 interposed therebetween.

The first holding unit including the first supporting piece 7 can hold coins of one denomination including a maximum diameter coin or coins of a plurality of denominations including a maximum diameter coin and not including a minimum diameter coin, and can deliver the coins to the next step. For example, two types of coins having the largest diameter and coins having the second largest diameter are delivered to the next step, and then coins having smaller diameters are dropped into the storage container 42. In addition, the second holding unit or the third holding unit including the second supporting piece 8 or the third supporting piece 9 can hold coins of one denomination or coins of a plurality of denominations not including a maximum diameter coin and deliver the coins to the next step. For example, coins having a diameter equal to or less than the diameter of the second largest coin next to the maximum diameter coin are delivered to the next step.

The disc 2 includes three holding units. In a configuration in which one of the holding units handles only maximum diameter coins, the efficiency of sending out the coins is reduced. When a small coin is put into the holding unit, the coin is returned to the storage container 42. Consequently, it is also possible to handle coins of a plurality of sizes including a maximum diameter coin in order to increase efficiency. In addition, it is also possible to provide a large number of holding units by increasing the diameter of the disc 2, but there is then a problem in that the device becomes large.

Next, reciprocations of the first supporting piece 7, the second supporting piece 8, and the third supporting piece 9 will be described. FIG. 5 is a diagram showing operations of a disc portion. A grooved cam 86 indicated by a dotted line in the frame (25 in FIG. 1) is disposed on the back surface side of the disc 2. A cam follower, not shown in the drawing, which moves along the grooved cam 86 is disposed in each of the first supporting piece 7, the second supporting piece 8, and the third supporting piece 9. When the disc 2 rotates, each of the cam followers moves along the grooved cam, and each of the supporting pieces moves in association with the movement of the corresponding cam follower. Each of the supporting pieces move along the elongate hole to which each of the supporting pieces corresponds. The first supporting piece 7 reciprocates between both ends of a first movement path 83 along the first elongate hole 10 provided in the disc 2. Similarly, the second supporting piece 8 reciprocates between both ends of a second movement path 84 along the second elongate hole 11, and the third supporting piece 9 reciprocates between both ends of a third movement path 85 along the third elongate hole 12.

When the supporting pieces are moved to at least a position corresponding to the storage container 42, it is preferable that the grooved cam 86 be formed such that the supporting pieces are held in the central direction of the disc 2 for a predetermined period. This is to stop the supporting pieces on one end sides of the respective movement paths and make coins easily enter the holding units. In addition, the holding units are moved upward and moved such that the supporting pieces are positioned at the other end sides of the respective movement paths at a position where coins are delivered. That is, the grooved cam 86 is formed such that the supporting pieces are held at the other end sides for a predetermined period. This is to deliver coins to the next step from the disc 2. A rotation angle and the timing and position of a reciprocation are determined according to the shape of the grooved cam 86.

Next, the delivery of coins from the sending portion 37 to the identification unit 38 will be described. FIG. 6 is a diagram showing the delivery of coins. A case where the coin 70 is delivered by the second supporting piece 8 will be described.

The disc 2 rotates in the disc rotation direction 33 indicated by an arrow. The reception wheel 27 rotates in the reception wheel rotation direction 44 indicated by an arrow. When the disc 2 rotates, the coin 70 is inserted into the second holding unit including the second supporting piece 8, and the coin is moved upward in association with the rotation of the disc 2. The delivery port (101 in FIG. 1) delivering the coin 70 to the identification unit 38 is provided above the sending portion 37. The second supporting piece 8 is moved in the direction of the outer circumferential side of the disc 2 in the vicinity of the delivery port. In this case, a portion of the coin 70 is inserted into the reception base 32. When the coin 70 abuts on the reception knife 22 or the reception wheel 27, the coin 70 is separated from the second supporting piece 8. The coin separated from the second supporting piece 8 is moved along a movement direction 87 indicated by an arrow and is inserted between the second reception body 29 and the third reception body 30. The pressing wall (35 in FIG. 1) of the second reception body 29 abuts on the coin 70 in an abutting direction 89 of a reception wheel indicated by an arrow and flips the coin 70. The flipped coin 70 completely moves to the reception base 32 as indicated by a moved coin 88 indicated by a dotted line. Thereafter, the denomination of the coin 88 is identified in a process in which the coin 88 is pressed against the second reception body 29 and moves along the guidance portion 31.

The rotation of the disc 2 and the rotation of the reception wheel 27 are synchronized with each other. The coin delivery device 1 rotates the disc 2 to make the disc pass through the inside of the storage container 42, thereby holding coins in the holding units of the disc 2 one by one. The disc 2 moves the supporting pieces at an upper position in a rotation track to make a portion of a held coin be caught in the reception base 32. When a coin abuts on the reception knife 22 or the reception wheel 27, the coin moves to the reception base 32 while being flipped. Thereafter, the coin is delivered from the sending portion 37 to the identification unit 38.

Since a movement distance of the first supporting piece 7 is short, a small coin may be returned to the storage container 42 without riding on the reception base 32 side even when the coin abuts on the reception knife 22 or the reception wheel 27.

Next, a coin held by the disc 2 will be described. FIG. 7 is a diagram showing a first example of the disc 2 in a state where a large diameter coin is held. The disc 2 rotates in the disc rotation direction 33 indicated by an arrow. When three holding units of the disc 2 pass through the inside of the storage container (42 in FIG. 2) disposed below the disc 2, the coin can be held on the holding base (17 in FIG. 4). However, the diameter of a coin that can be held is determined in advance. For example, there is only one holding unit that can hold a maximum diameter coin 91 having a maximum diameter among coins to be used. In the coin delivery device 1 according to the embodiment, only the first holding unit having the first supporting piece 7 disposed therein holds the maximum diameter coin 91. The second holding unit having the second supporting piece 8 disposed therein and the third holding unit having the third supporting piece 9 disposed therein cannot hold the maximum diameter coin 91 as indicated by a shadow 90 of the maximum diameter coin indicated by a dashed line. The maximum diameter coin 91 is conveyed while being supported by the first side wall 14 or the third side wall 16. In addition, the maximum diameter coin 91 is conveyed without abutting on the second side wall 15 which is an inclined portion.

FIG. 8 is a diagram showing a second example of the disc 2 which is holding a large diameter coin. The disc 2 rotates in the disc rotation direction 33 indicated by an arrow. The disc 2 of the second example includes a fourth supporting piece 92 of which the tip end is extended to a position corresponding to the first side wall (14 in the FIG. 4) as compared to the first supporting piece 7 shown in FIG. 7. Thereby, the sorting portion 13 has a shape in which the portion of the first side wall 14 is removed and the portion of the second side wall 15 remains. Although the maximum diameter coin 91 is supported by the first side wall 14 in the first example shown in FIG. 7, the maximum diameter coin 91 is supported by the fourth supporting piece 92 in the second example shown in FIG. 8. The sorting portion 13 can also include only the portion of the second side wall 15 including an inclined portion. The maximum diameter coin 91 is conveyed while being supported by the fourth supporting piece 92 or the third side wall (16 in FIG. 4). In addition, the maximum diameter coin 91 is conveyed without abutting on the second side wall 15. The upstream side of the fourth supporting piece 92 in a rotation direction can also be treated as an extended portion of the third side wall 16, and the downstream side can also be treated as an extended portion of the first side wall 14. In this case, a small diameter coin slides down by the sorting portion 13.

FIG. 9 is a diagram showing a state where two or more small diameter coins are held in the disc 2 including the first supporting piece 7. In a case where a small diameter coin having a diameter equal to or less than half the diameter of a maximum diameter coin is used, a plurality of small diameter coins may be put into the first holding unit that can hold the maximum diameter coin.

For example, a case where a minimum diameter coin 93 having a diameter equal to or less than half the diameter of a maximum diameter coin is used will be described. In the first holding unit having the first supporting piece 7 disposed therein can hold a maximum diameter coin. Three minimum diameter coins 93 are put into the first holding unit. When the three coins are delivered to the next step at the same time, there is a concern that an erroneous operation may occur. On the other hand, two minimum diameter coins 93 are not simultaneously put into the second holding unit or the third holding unit in which the second supporting piece 8 or the third supporting piece 9 is disposed, as indicated by a minimum diameter coin shadow 95. Only one coin from the minimum diameter coin 93 to the medium diameter coin 94 having a diameter smaller than the predetermined maximum diameter is inserted into the second holding unit or the third holding unit.

In this manner, there is a possibility that two or more coins to be used will be sent at the same time depending on sizes. Accordingly, it is necessary to prevent two or more coins from being sent to the next step at the same time. Next, an operation of a small diameter coin will be described. FIG. 10 is a diagram showing a first example of an operation of the disc 2 that holds a small diameter coin. A case where two small diameter coins 96 are put into the first holding unit having the first supporting piece 7 disposed therein will be described. The disc 2 rotates in the disc rotation direction 33 indicated by an arrow.

The disc 2 rotates, and the small diameter coin 96 moves from the lowest point of the disc 2 to the upstream side in the disc rotation direction. In this case, when the diameter of the small diameter coin 96 is large to a certain degree, the small diameter coin 96 is caught on the first side wall 14 and conveyed. However, when the diameter of the small diameter coin 96 is small, the small diameter coin 96 is caught on only the second side wall 15 and conveyed. The second side wall 15 is an inclined portion that protrudes toward the upstream side of the holding base 17 in a rotation direction. The small diameter coin 96 moves along the inclined portion, and thus the first holding unit cannot continuously hold the small diameter coin 96. That is, the small diameter coin 96 slides down on the second side wall 15. The sliding-down small diameter coin 96 is returned to the storage container 42. The first holding unit having the first supporting piece 7 disposed therein can be returned to the storage container 42 without conveying coins having a size equal to or less than a predetermined size. That is, in a case where the first holding unit holds a coin having a diameter smaller than a first diameter, the first holding unit slides the held small diameter coin down until the first holding unit moves to a position facing the delivery port (101 in FIG. 1)

in association with the rotation of the disc 2. It is possible to determine the diameter of a coin returned to the storage container 42 on the basis of a distance from the outer circumference of the disc 2 to the end of the second side wall 15.

FIG. 11 is a diagram showing a second example of an operation of the disc 2 that holds a small diameter coin. A case where the small diameter coin 96 having a size which is not originally conveyed is inserted into the first holding unit having the first supporting piece 7 disposed therein will be described. When the first supporting piece 7 is conveyed to the upper position of the disc 2, the first supporting piece is moved to the position (tip end position) of the first supporting piece 72. In this case, a medium diameter coin 99 indicated by an alternating dotted-dashed line abuts on the reception knife 22 or the reception wheel 27 and can move in the direction of the reception base 32. However, the small diameter coin 96 which is not originally conveyed to the position falls into the storage container 42. In a case where the small diameter coin 96 is conveyed to the above-described position, an upper side of a side surface of the small diameter coin 96 abuts on the reception knife 22. In this case, the small diameter coin 96 rides on the first inclined portion 74 or the second inclined portion 75 and floats up, like a shadow 97 of a small diameter coin indicated by a dashed line. In addition, the coin drops in a coin dropping direction 100 indicated by an arrow, that is, into the storage container 42 and returns. The reception knife 22 functions as a blocking unit that blocks the sending-out of a coin, which has a diameter smaller than the first diameter and is held by the first holding unit, from the first holding unit to the next step. Only coins having a diameter equal to or larger than the first diameter can be sent out to the next step from the first holding unit by the blocking unit.

It is possible to prevent the rotation of the disc 2 from being hindered by small coins being lined up. In addition, coins having a size equal to or larger than a predetermined size and put into the holding unit are delivered to the next step, but coins having a size less than the predetermined size are returned to the storage container 42. In this manner, it is possible to deliver coins one by one to the next step by preventing two or more coins from being held. In addition, only one coin is put into the other holding units, and thus coins can be reliably delivered one by one to the next step.

EXPLANATION OF REFERENCES

1 Coin delivery device
2 Disc
3 Disc rotary shaft
4 First arm
5 Second arm
6 Third arm
7 First supporting piece
8 Second supporting piece
9 Third supporting piece
10 First elongate hole
11 Second elongate hole
12 Third elongate hole
13 Sorting portion
14 First side wall
15 Second side wall
16 Third side wall
17 Holding base
18 Fourth side wall
19 Fifth side wall
20 Sixth side wall
21 Seventh side wall
22 Reception knife
23 Knife tip end portion
24 Motor
25 Frame
26 Wheel rotary shaft
27 Reception wheel
28 First reception body
29 Second reception body
30 Third reception body
31 Guidance portion
32 Reception base
33 Disc rotation direction
34 Manual knob
35 Pressing wall
36 Identification sensor
37 Sending portion
38 Identification unit
39 Accommodation unit
40 Coin slot
41 Coin passage
42 Storage container
43 Guiding path
44 Reception wheel rotation direction
45 Belt rotation direction
46 Belt
47 Conveyance pin
48 First slide
49 First coin hopper
50 Second slide
51 Second coin hopper
52 Third slide
53 Third coin hopper
54 Fourth slide
55 Fourth coin hopper
56 Fifth slide
57 Fifth coin hopper
58 Sixth slide
59 Sixth coin hopper
60 Seventh slide
61 Seventh coin hopper
62 Eighth slide
63 Eighth coin hopper
64 Ninth slide
65 Collecting container
66 Dispensing belt
67 Dispensing tray
68 Conveyance path
69 Coin processing device
70 Coin
71 Bar
72 First supporting piece positioned at tip end
73 Pressing portion
74 First inclined portion
75 Second inclined portion
76 Dotted line indicating contour
77 Distance to contour portion
78 Bent portion
79 Edge
80 Support side surface
81 Tip end
82 Second supporting piece positioned at tip end
83 First movement path
84 Second movement path
85 Third movement path
86 Grooved cam
87 Movement direction of coin

88 Moved coin
89 Abutting direction of reception wheel
90 Shadow of maximum diameter coin
91 Maximum diameter coin
92 Fourth supporting piece
93 Minimum diameter coin
94 Medium diameter coin
95 Minimum diameter coin shadow
96 Small diameter coin
97 Shadow of small diameter coin
98 Movement direction of small diameter coin
99 Medium diameter coin
100 Coin dropping direction
101 Delivery port

What is claimed is:

1. A coin delivery device comprising:

a disc that has a holding unit on an upper surface thereof, the holding unit holding a coin;

a storage container that stores a plurality of the coins; and a supporting piece that presses side surfaces of the coins held by the holding unit to move the coins in a direction circumferentially outward from the disc, wherein:

the coin delivery device is configured to hold the coins in the storage container by the holding unit and rotate the disc to send out the coins moving in the outer circumferential direction of the disc by the supporting piece one by one to a next step from a delivery port disposed on an upper side of the disc, and is configured such that the disc is disposed obliquely with respect to the storage container, and the storage container is disposed on a lower side of the disc, the holding unit includes a first holding unit and a second holding unit which is smaller than the first holding unit, the first holding unit sending out only coins having a diameter equal to or larger than a first diameter to the next step from the delivery port and not sending out coins having a diameter less than the first diameter to the next step from the delivery port in a case where the number of coins held is one, and not sending out two coins held to the next step from the delivery port in a case where the number of coins held at the same time is two, and the second holding unit not holding coins having a diameter exceeding a second diameter smaller than a maximum diameter among the coins held by the first holding unit, and sending out the coin to the next step from the delivery port and not holding two coins having a diameter equal to or less than the second diameter at the same time in a case where the second holding unit holds one coin having a diameter equal to or less than the second diameter, the first holding unit includes a first upstream side convex portion and a first holding base, the first upstream side convex portion being provided on an upstream side of the first holding base in a rotation direction of the disc, abutting on the side surfaces of the coins, and conveying the coins in the rotation direction of the disc, and the first holding base being disposed on a downstream side of the first upstream side convex portion in the rotation direction of the disc and having the coins placed thereon, the second holding unit includes a second upstream side convex portion and a second holding base, the second upstream side convex portion being provided on an upstream side of the second holding base in the rotation direction of the disc, abutting on the side surfaces of the coins, and conveying the coins in the rotation direction of the disc, and the second holding base being disposed on a downstream side of the second upstream side convex portion in the rotation direction of the disc and having the coins placed thereon, a portion of the second upstream side convex portion which abuts on the side surfaces of the coins and is closest to an outer circumference of the disc is disposed at a position closer to the outer circumference of the disc than a position of the first upstream side convex portion which abuts on the side surfaces of the coins and is closest to the outer circumference of the disc, the first upstream side convex portion includes a supporting portion that supports the coins while abutting on the side surfaces of the coins, and an inclined portion which is disposed between the supporting portion and the outer circumference of the disc and becomes higher toward an upstream direction of the rotation direction of the disc from the first holding base, and the coins having a diameter less than the first diameter are dropped into the storage container by the inclined portion.

2. The coin delivery device according to claim 1, further comprising:

a blocking unit that blocks the sending-out of the coins from the first holding unit to the next step in a case where the coins having a diameter smaller than the first diameter are held by the first holding unit.

3. The coin delivery device according to claim 1, wherein in a case where the first holding unit holds the coins having a diameter smaller than the first diameter, the first holding unit slides the held coins down until the first holding unit moves to a position facing the delivery port in association with rotation of the disc.

4. The coin delivery device according to claim 1, wherein the supporting piece includes a first supporting piece provided in the first holding unit, and a second supporting piece provided in the second holding unit, a guidance surface that abuts on the side surfaces of the coins and guides conveyance of the coins is provided outside the outer circumference of the disc, the first holding unit includes a first downstream side convex portion and the first supporting piece on a downstream side of the first holding base in the rotation direction of the disc, the first downstream side convex portion abutting on the side surfaces of the coins, and the first supporting piece moving the coins between the first upstream side convex portion and the first downstream side convex portion in a direction of the outer circumference, and the coins are conveyed in a state where at least three sides are surrounded by the first upstream side convex portion, the first downstream side convex portion, and the guidance surface, and are moved in a direction of the delivery port by the first supporting piece, and the second holding unit includes a second downstream side convex portion and the second supporting piece on a downstream side of the second holding base in the rotation direction of the disc, the second downstream side convex portion abutting on the side surfaces of the coins, and the second supporting piece moving the coins between the second upstream side convex portion and the second downstream side convex portion in the direction of the outer circumference, and the coins are conveyed in a state where at least three sides are surrounded by the second upstream side convex portion, the second downstream side convex portion, and the guidance surface, and are moved in the direction of the delivery port by the second supporting piece.

5. The coin delivery device according to claim 4, wherein the first supporting piece includes a pressing portion and a supporting piece inclined portion and slides the coins having a diameter less than the first diameter down into the storage container by the supporting piece inclined portion, the pressing portion abutting on the side surfaces of the coins and pressing the coins, and the supporting piece inclined portion being disposed in a portion of the upstream side in the rotation direction of the disc from a central portion of the first supporting piece and having a thickness that increases in a thickness direction of the first supporting piece toward a center of the disc.

6. A coin processing device comprising:

the coin delivery device according to claim 1;

an identification unit that receives the coins from the coin delivery device and identifies denominations of the coins; and an accommodation unit that includes coin hoppers corresponding to the denominations of the coins and accommodates the coins in the coin hoppers, wherein the coins are stored in the coin hoppers corresponding to the denominations identified by the identification unit.

* * * * *